United States Patent [19]

Frechin

[11] 4,026,576

[45] May 31, 1977

[54] SELF RESTORING RELEASABLE SKI BINDING

[75] Inventor: Jean-Paul Frechin, Chamonix, France

[73] Assignee: Garcia Corporation, Teaneck, N.J.

[22] Filed: May 22, 1975

[21] Appl. No.: 579,933

[30] Foreign Application Priority Data

May 31, 1974 France .....74.19127

[52] U.S. Cl. ..... 280/613; 280/618; 280/637

[51] Int. Cl.[2] ..... A63C 9/08

[58] Field of Search ..... 280/11.35 N, 11.35 K, 280/11.35 D, 11.35 E, 11.35 A, 11.35 R, 613, 618, 637, 611

[56] References Cited

UNITED STATES PATENTS

| | | | |
|---|---|---|---|
| 3,822,070 | 7/1974 | Salomon | 280/11.35 N |
| 3,871,674 | 3/1975 | Bunn, Jr. | 280/11.35 N |
| 3,893,682 | 7/1975 | Weinstein et al. | 280/11.35 N |
| 3,936,066 | 2/1976 | Witting | 280/637 |

*Primary Examiner*—Joseph F. Peters, Jr.
*Assistant Examiner*—Milton L. Smith
*Attorney, Agent, or Firm*—Fitzpatrick, Cella, Harper & Scinto

[57] ABSTRACT

A safety ski binding has a hollow hole plate of uniform thickness removably fixable under a boot sole. The ends of the sole plate are each retained on a ski by a respective flexible cable held under tension by respective spiral-spring winders both housed within the sole plate.

2 Claims, 2 Drawing Figures

SELF RESTORING RELEASABLE SKI BINDING

BACKGROUND OF THE INVENTION

The invention concerns ski bindings of the type comprising a sole plate on which a boot can be held. In a known arrangement, sold under the Trade Mark "Burt", each end of such a sole plate is retained on a ski by means of a respective flexible cable a part of which is held by the ski and one end of which is permanently held under tension by spring means. Both spring means are supported by the sole plate, that of the front or toe retaining cable being housed within the thickness of the plate, and that of the rear or heel retaining cable being disposed in a case disposed vertically at the rear of the sole plate. While this known binding includes numerous advantageous features, the rear cable housing increases the overall weight of the sole-plate and, to some skiers, is undesirably bulky.

SUMMARY OF THE INVENTION

A specific object of the invention is to reduce the weight and bulk of such a binding while conserving the advantageous features inherent to a binding having a sole plate held on the ski by flexible cables held under tension by elastic biasing means. The main advantageous feature is that in the event of a fall of the skier, such a sole plate can release in any direction in response to the various stresses acting, and the ski can be automatically returned to bear under the sole plate as soon as the stresses cease.

A further object of the invention is to provide such a binding in which any easily manouverable heel-grip can be fitted to the rear of the sole plate.

In broad terms, such a binding according to the invention is characterized in that the elastic biasing means for the cables or connections holding the front and rear ends of the sole plate are both housed within the thickness of the sole plate.

BRIEF DESCRIPTION OF THE DRAWINGS

An embodiment of the invention is shown, by way of example, in the accompanying drawings, in which.

DESCRIPTION OF THE PREFERRED EMBODIMENT

Figure 1:
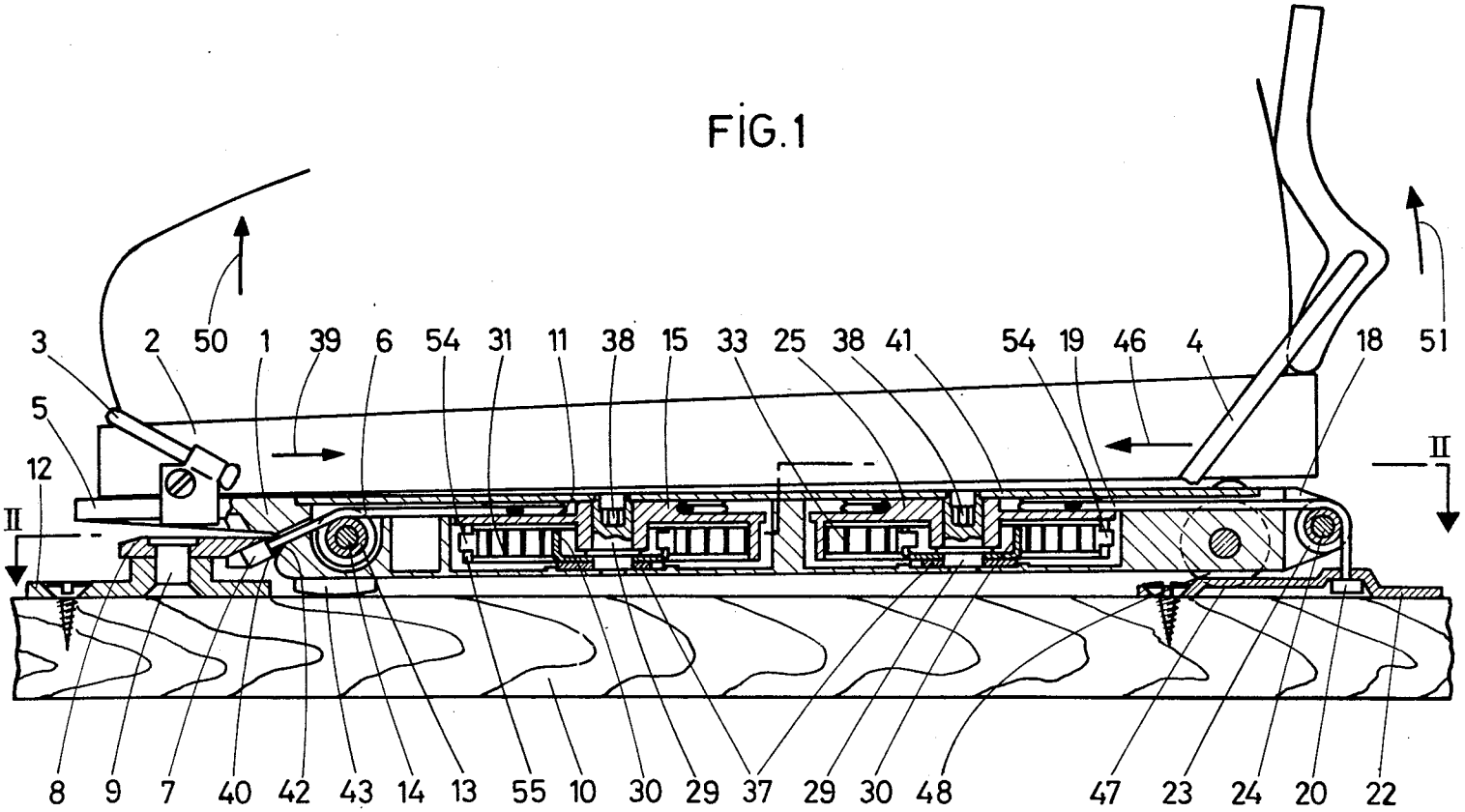
FIG. 1 is a longitudinal cross-section of a binding, taken along line I—I of FIG. 2, and holding a boot on a ski.

As shown, the ski binding comprises a hollow flat sole plate 1 of generally uniform thickness along its entire length, able to be fitted under the sole 2 of a boot by front and rear grips 3 and 4 respectively.

The rear end 18 of plate 1 is held on ski 10 by flexible and substantially inextensible ski connector leash or strand or cable 19. For this purpose, as shown, an enlarged end 20 of cable 19 is secured in a heel engagement plate 22 screwed on ski 10 after leaving plate 22, cable 19 passes over a pulley 23 freely turning on a pin 24 fixed in an opening in the rear end of plate 1, and the cable then passes along a groove 26, for example of spiral shape as shown, in a cam-like winder 25 and its other enlarged end 27 is held in one of several housings in winder 25.

The front end 5 of plate 1 as shown is similarly held on ski 10 by a second flexible ski connector leash or cable 6. An enlarged end 7 of cable 6 is secured to a turning toe engagement element 8 pivoted on a pin 9 fixed to the ski by a plate 12 screwed on ski 10. From this element 8, cable 6 passes over a pulley 13 freely turning about a pin 14 fixed in an opening in plate 1; then it passes along a groove, for example of spiral shape, at the periphery of a cam-like winder 15 and its second enlarged end 11 is held in one of several openings, not shown, in the winder 15, in the same manner as for winder 25.

Figure 2:
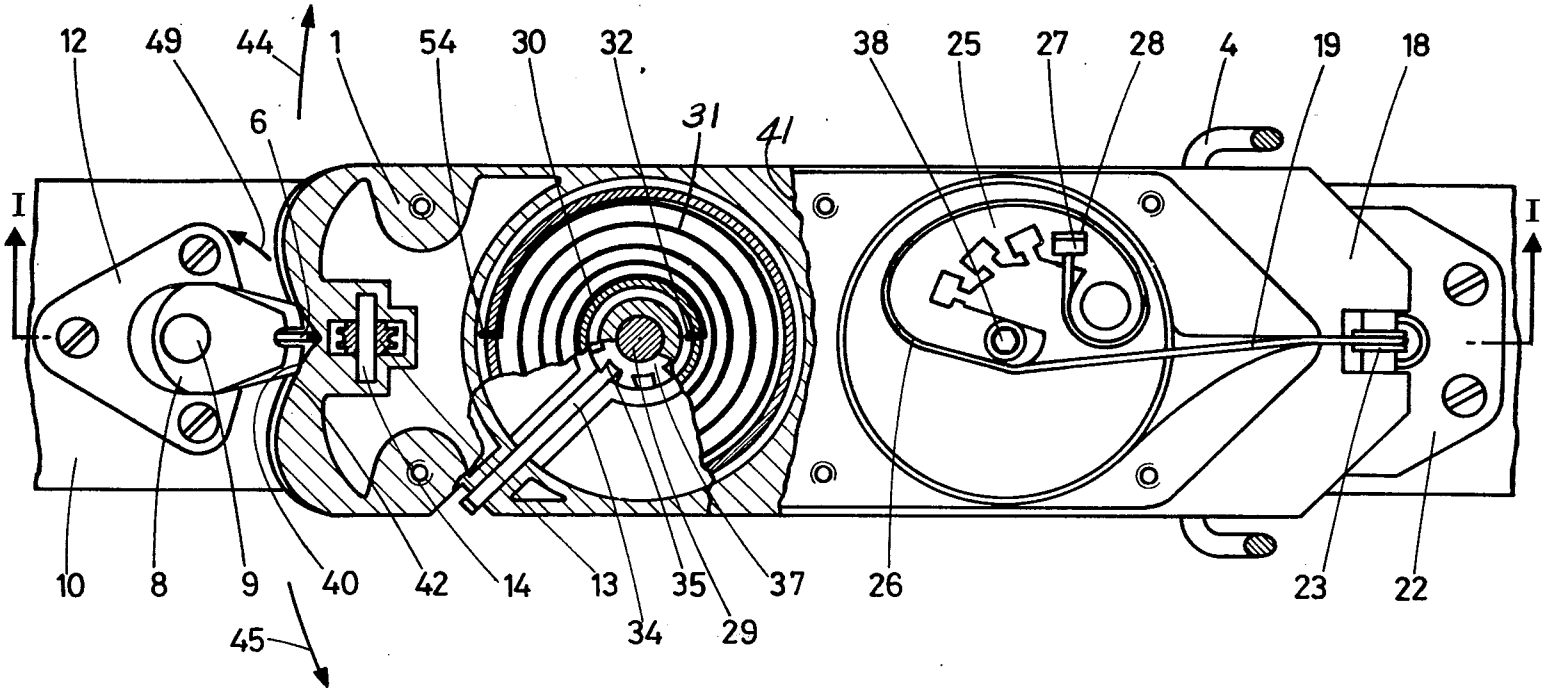
FIG. 2 is a cross-section along line II—II of FIG. 1, partly in plan view with the boot removed.

The winders 15 and 25 are each pivoted on a rotatable shaft 29 carrying a rim 30 which is keyed for rotation with the shaft. To this rim 30 is secured the inner end 32 of a spiral spring 31, 33 respectively. The outer end 54 of each spring is hooked to a drum 55 integral with the respective winder 15, 25. A pusher 34 (FIG. 2) able to lodge in one of several notches 35 of a toothed wheel 37 fixed on shaft 29, serves to angularly fix the shaft 29 and thus hold the tension of the spring at a value set by rotation of rim 30 by means of an Allen key engaging in a polygonal opening 38 in the accessible upper end of shaft 29. A cover 41 is placed on plate 1, over winders 15 and 25.

The traction on toe engagement element 8, exerted in rearranged direction 39 by front cable 6 under the action of spring 31, tends to hold a profiled part 42 of the front end of plate 1 with forward pressure against a part 40 of complementary profile on turning element 8. Two rollers 43, pivoted on the front end of plate 1 about longitudinal axes, bear on ski 10 and allow rolling of plate 1 on ski 10 in transverse directions 44 and 45. FIG. 1 shows a lower portion of one roller 43.

The traction on heel engagement plate 22, exerted in forward direction 46 by rear cable 19 under the action of spring 33 becomes substantially perpendicular to the surface of ski 10 as rear cable 19 passes over pulley 23 thus tending to hold rollers 48 (which are pivoted on plate 1 about a transverse horizontal axis) down against parts 47 of this plate 22. These parts 47 and rollers 48 are of complementary profile arranged so that the plate 1 always tends to be centered on ski 10 when it is held against plate 22. These parts 47 are also sufficiently long to allow rolling of rollers 48 and hence a given axial movement of plate 1 in direction 39 or 46.

When there is a slight force on sole 2 transverse to the ski, for example in direction 44, plate 1 pivots slightly in direction 44 by rolling of its rollers 43, but it remains held on ski 10 by the profile 40 of element 8 which engages the complementary profile 42 of plate 1. If the force ceases, plate 1 is moved back to its normal centered position by spring 31, winder 15 and cable 6. If, however, the force exceeds a certain predetermined value, profile 42 disengages from profile 40, element 8 pivoting as indicated at 49, and the plate 1 is able to move away from ski 10. At the moment when profile 42 disengages from profile 40, plate 1 moves back slightly in direction 39 by rolling on its rear rollers 48. As soon as the force on sole 2 ceases, the traction exerted by spring 31 of winder 15 brings the ski 10 back against rollers 43, and the binding thus once more returns to its normal "skiing" position.

In the event where, upon a forward fall of the skier, a force tends to lift the rear of sole 2 as indicated at 51, the plate 1 tends by winder and cable mechanism 25, 19; to lift ski 10 in the same direction 51. If this force exceeds a given preset value, the plate 1 lifts up so that rollers 48 leave their supporting part 47 of plate 22, and the boot is thus freed from the ski at the same time as plate 1. As soon as the force on sole 2 ceases, the traction exerted by spring 33 of winder 25 brings the ski 10 back under rollers 48, and the binding once more automatically assumes its normal "skiing" position.

The elastic biasing means for each cable could be other than a spiral spring. In a simplified embodiment, the cable could be secured to a spring, e.g., a tension spring. Also, the front and rear cables could have elastic biasing means of different types. Also, instead of the end 20 of cable 19 being secured to the ski it could be secured to plate 1 and for example be attached to the ski by passing around a pulley fixed on the ski.

It is of course understood that the terms leash, cable and flexible connection as used herein are meant to include all suitable flexible strands, cords, wires and other substantially non-extensible flexible elongate members.

What is claimed is:

1. A ski binding having release and return capabilities comprising:

a hollow sole plate of substantially uniform thickness;

gripping means mounted to said sole plate for holding the sole of a ski boot thereon;

front and rear winders housed within said sole plate, said winders being elastically biased by string means;

a front cable and a rear cable, said front cable having one end connected to said front winder and the other end extending from the front of said sole plate, said rear cable having one end connected to said rear winder and the other end extending from the rear of said sole plate, each of said cables being tensioned by said respective winders;

a front engagement means constructed and arranged to secure the extending end of said front cable to a ski whereby the front of said sole plate is urged forwardly thereagainst by said front cable;

a rear engagement means constructed and arranged to secure the extending end of said rear cable to said ski whereby the rear of said sole plate is urged downwardly thereagainst by said rear cable; and guide means arranged at the rear of said sole plate over which said cable passes whereby the traction exerted by said cable upon said rear engagement means is normally substantially perpendicular to said ski.

2. A ski binding according to claim 1 wherein said spring means are spiral springs mounted coaxially with said winders.

* * * * *

UNITED STATES PATENT OFFICE

CERTIFICATE OF CORRECTION

Patent No. 4,026,576 Dated May 31, 1977

Inventor(s) Jean-Paul Frechin

It is certified that error appears in the above-identified patent and that said Letters Patent are hereby corrected as shown below:

Col. 4, line 4, "string" should be --spring--;

Col. 4, line 22, after "said" insert --rear--.

Signed and Sealed this second Day of August 1977

[SEAL]

Attest:

RUTH C. MASON
*Attesting Officer*

C. MARSHALL DANN
*Commissioner of Patents and Trademarks*